US007764889B2

(12) United States Patent
Hamaya et al.

(10) Patent No.: US 7,764,889 B2
(45) Date of Patent: Jul. 27, 2010

(54) IMAGE-FORMING DEVICE

(75) Inventors: Masahito Hamaya, Nagoya (JP); Hiroyuki Naganawa, Kasugai (JP); Katsumi Inukai, Iwakura (JP); Kazushi Fukuta, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 586 days.

(21) Appl. No.: 11/773,844

(22) Filed: Jul. 5, 2007

(65) Prior Publication Data

US 2008/0008483 A1 Jan. 10, 2008

(30) Foreign Application Priority Data

Jul. 5, 2006 (JP) ..... 2006-185751

(51) Int. Cl.
*G03G 15/00* (2006.01)

(52) U.S. Cl. ..... 399/44

(58) Field of Classification Search ..... 399/44, 399/71, 98, 99, 101, 343, 354, 357
See application file for complete search history.

(56) References Cited

U.S. PATENT DOCUMENTS

| | | | | |
|---|---|---|---|---|
| 4,470,694 | A * | 9/1984 | Murakami et al. | 399/354 |
| 5,175,584 | A * | 12/1992 | Usui | 399/44 |
| 5,839,018 | A * | 11/1998 | Asanuma et al. | 399/43 |
| 5,966,558 | A * | 10/1999 | Kikui | 399/44 |
| 6,463,223 | B1 * | 10/2002 | Karakama et al. | 399/27 |
| 6,744,994 | B2 * | 6/2004 | Yoshikawa et al. | 399/44 |

FOREIGN PATENT DOCUMENTS

| | | |
|---|---|---|
| JP | 05-045994 | 2/1993 |
| JP | 06-068666 | 8/1994 |
| JP | 08-220892 | 8/1996 |
| JP | 11-184262 | 7/1999 |
| JP | 2005-004079 | 1/2005 |
| JP | 2005-242179 | 9/2005 |
| JP | 2005-266604 | 9/2005 |

OTHER PUBLICATIONS

Japanese Office Action in JP 2006-18751, Mailing Date: Aug. 19, 2008.

* cited by examiner

*Primary Examiner*—David P Porta
*Assistant Examiner*—Kiho Kim
(74) *Attorney, Agent, or Firm*—Banner & Witcoff, Ltd

(57) ABSTRACT

An image-forming device includes a cleaning unit, a toner detection unit, a control unit, and a cleaning target member in the housing. The cleaning unit applies a predetermined voltage with a predetermined absolute value to the cleaning target member to remove toner from the cleaning target member through an electrostatic force. The toner detection unit detects an amount of toner on the cleaning target member at least twice to detect a first amount of toner and a second amount of toner. The first amount and the second amount of toner are detected when a first voltage having a first absolute value is applied as the predetermined voltage at a first time and when a second voltage having a second absolute value is applied as the predetermined voltage at a second time. The control unit determines the predetermined absolute value based on the first toner amount and the second toner amount.

15 Claims, 12 Drawing Sheets

IMAGE-FORMING DEVICE

CROSS REFERENCE TO RELATED APPLICATION

This application claims priority from Japanese Patent Application No. 2006-185751 filed Jul. 5, 2006. The entire content of the priority application is incorporated herein by reference.

BACKGROUND OF THE INVENTION

1. Field of the Invention

The present invention relates to an electrophotographic image-forming device, and particularly to a tandem color laser printer for printing on a recording sheet and having a plurality of process cartridges arranged in a series along the direction in which the recording sheet is conveyed.

2. Description of the Related Art

Electrophotographic image-forming devices well known in the art form images on recording sheets, such as paper or transparencies, by transferring toner supplied from toner cartridges onto the recording sheet. In this type of image-forming device, part of the toner supplied from the toner cartridges may be deposited on an intermediate transfer belt and/or a conveying belt, and go unused.

When performing subsequent printing operations with toner deposited on the conveying belt, the toner on the conveying belt may transfer to the back surface of the recording sheet, forming unnecessary and unintended images on the recording sheet.

Japanese patent application publication No. 2005-266604 discloses an image-forming device having a cleaning device for removing toner from the conveying belt through electrostatic attraction. This image-forming device regulates a bias voltage applied to the cleaning device to a suitable voltage for cleaning during prescribed non-image forming periods, such as when the power of the image-forming device is turned on or when the image-forming device is restored from the sleep mode.

However, the optimum value of the bias voltage applied to the cleaning device is not constant, but varies according to the usage frequency of the image-forming device and ambient temperature and humidity. If a fixed bias voltage is applied as the optimum voltage, the image-forming device may not be able to remove toner sufficiently.

Therefore, an object of the present invention is to provide an image-forming device having a cleaning unit capable of reliably cleaning toner which has deposited on the conveying belt at all times through electrostatic attraction.

SUMMARY OF THE INVENTION

The present invention provides an image-forming device having a housing, a cleaning unit, a toner detection unit, and a control unit. The cleaning target member is provided in the housing. The cleaning unit applies a predetermined voltage to the cleaning target member to remove toner from the cleaning target member through an electrostatic force. The predetermined voltage has a predetermined absolute value. The toner detection unit detects an amount of toner on the cleaning target member at least twice. The detected amount of toner includes a first amount of toner and a second amount of toner. The first amount of toner is detected when a first voltage having a first absolute value is applied as the predetermined voltage at a first time. The second amount of toner is detected when a second voltage having a second absolute value is applied as the predetermined voltage at a second time. The second time is later than the first time. The control unit determines the predetermined absolute value on the basis of the first amount of toner and the second amount of toner.

The present invention provides a method, having applying a predetermined voltage to a cleaning target member in an image-forming device to remove toner from the cleaning target member through an electrostatic force, the predetermined voltage having a predetermined absolute value; detecting an amount of toner on the cleaning target member at least twice, the detected amount of toner including a first amount of toner and a second amount of toner, the first amount of toner being detected when a first voltage having a first absolute value is applied as the predetermined voltage at a first time, the second amount of toner being detected when a second voltage having a second absolute value is applied as the predetermined voltage at a second time, and the second time being later than the first time; and determining the predetermined absolute value on the basis of the first amount of toner and the second amount of toner.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE EMBODIMENTS

Figure 1:
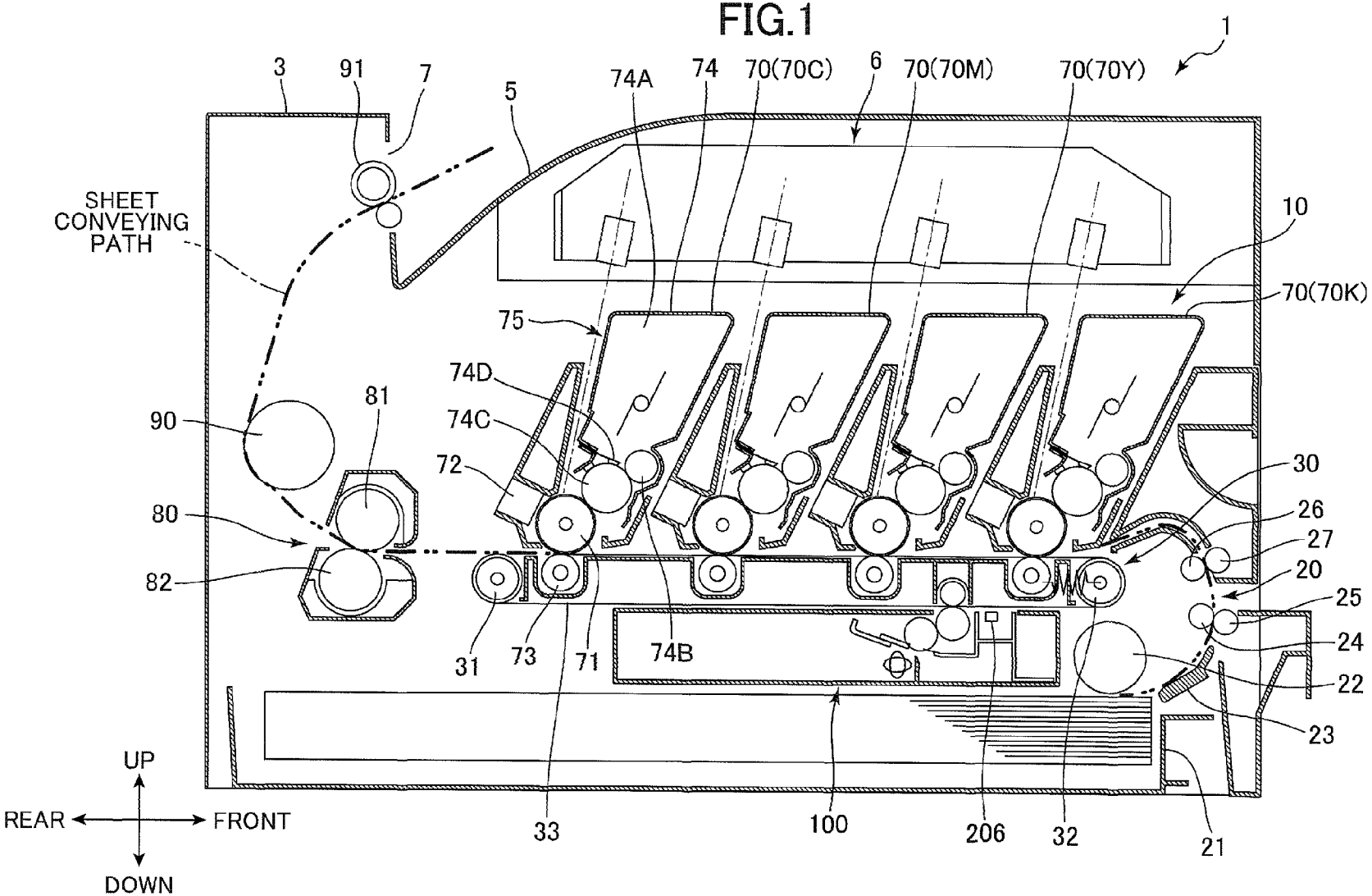
FIG. 1 is a side cross-sectional view of a laser printer according to a first embodiment of the present invention.

An image-forming device according to some embodiments of the invention will be described while referring to the accompanying drawings wherein like parts and components are designated by the same reference numerals to avoid duplicating description. In the following description, the expressions "front", "rear", "above", "below", "right", and "left" are used throughout the description to define the various parts when the image-forming device is disposed in an orientation in which the image-forming device is intended to be used.

Referring to FIG. 1, a laser printer 1 according to the present invention, which is connectable to a computer, has a casing 3 formed in a cubic shape. A discharge tray 5 is formed on the top surface of the casing 3 for receiving a sheet discharged from the casing 3 after a printing operation and for holding the sheet in a stacked state. The laser printer 1 has a feeding unit. 20, a conveying mechanism 30, an image-forming unit 10, and a fixing unit 80 in the casing 3.

In this embodiment, a frame member (not shown) formed of metal or resin is provided inside the casing 3. Process cartridges 70 and the fixing unit 80 are detachably mounted in the frame member, The feeding unit 20 includes a paper tray 21 disposed in the lowermost section of the casing 3 for accommodating the sheet in a stacked state; a feeding roller 22 disposed above the front end of the paper tray 21 for conveying the sheet in the paper tray 21 to the image-forming unit 10; and a separating pad 23 for separating the sheet fed by the feeding roller 22 so that the sheet is fed one by one at a time.

The sheet of paper fed from the paper tray 21 is conveyed along a paper-conveying path to the image-forming unit 10. The paper-conveying path has a substantially U-shaped section for changing the conveyed direction of the paper. A conveying roller 24 is disposed along this U-shaped section.

A pinch roller 25 is disposed at a position opposing the conveying roller 24 so that the sheet fed along the paper-conveying path is interposed between the conveying roller 24 and pinch roller 25.

Registration rollers 26 and 27 are disposed along the paper-conveying path downstream of the conveying roller 24.

The conveying mechanism 30 includes a drive roller 31 that rotates in association with operations of the image-forming unit 10; a follow roller 32 rotatably disposed in a position separated from the drive roller 31; and a conveying belt 33 stretched around the drive roller 31 and follow roller 32.

A belt cleaner 100 is provided for removing toner deposited on the surface of the conveying belt 33. Next, the belt cleaner 100 will be described in greater detail.

Figure 2:
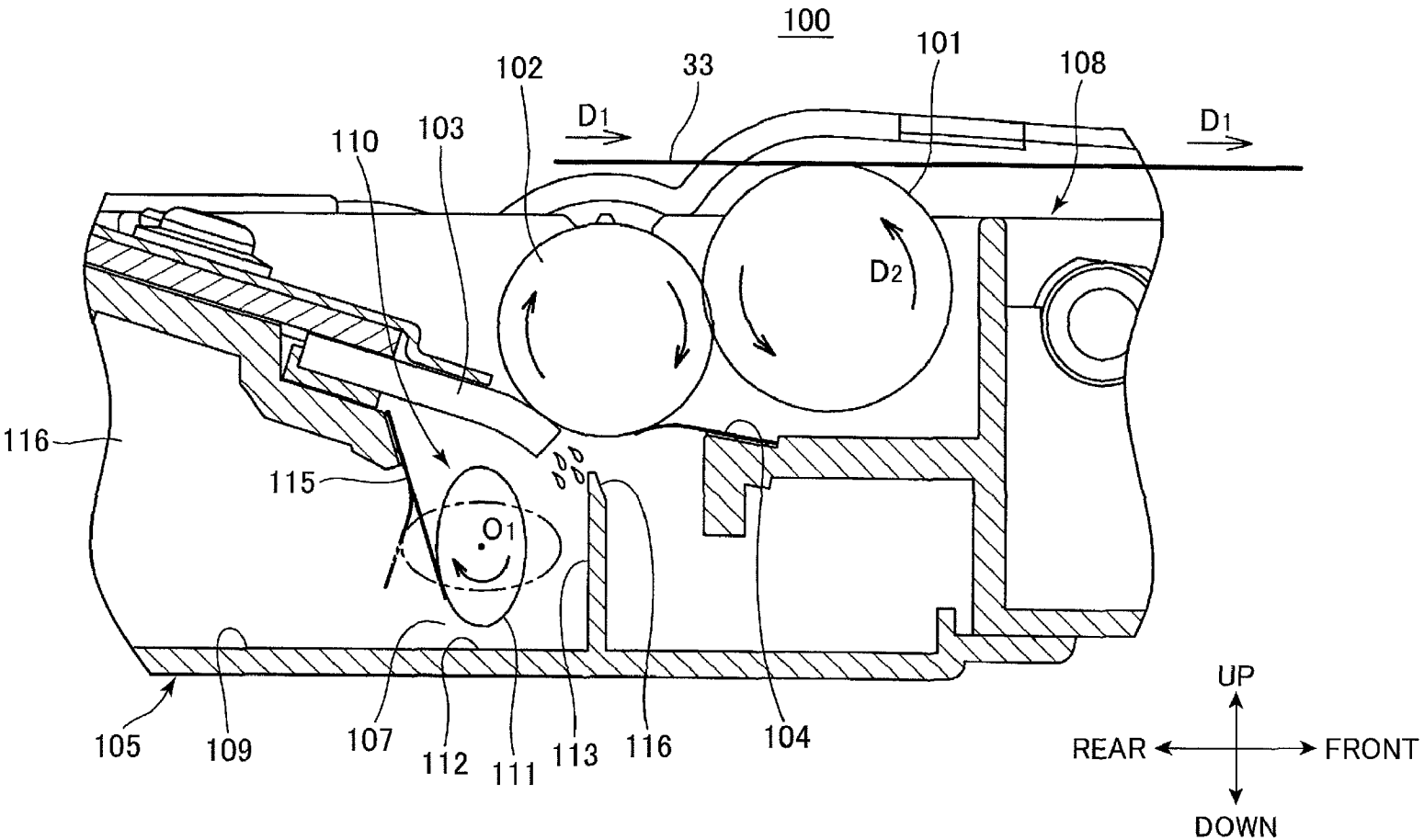
FIG. 2 is an enlarged view of a belt cleaner according to the first embodiment.

Referring to FIG. 2, the belt cleaner 100 has a cleaning roller 101, and a cleaning shaft 102. The cleaning roller 101 is disposed in confrontation with the conveying belt 33 for removing toner deposited on the surface of the conveying belt 33. The cleaning shaft 102 conveys toner deposited on the surface of the cleaning roller 101 to a toner collecting section 105.

The toner collecting section 105 is configured of a collection space 106 for accommodating toner. A toner-conveying pump mechanism 110 is disposed on the outside of the collection space 106 on either side of an inlet 107 to convey toner toward the collection space 106.

A voltage of an opposite polarity to the charge on the toner is applied to the cleaning roller 101 and cleaning shaft. 102. In other words, the potential of the cleaning roller 101 and the cleaning shaft 102 have the same polarity. Further, the applied voltages (hereinafter referred to as "bias voltages") are regulated so that the absolute values of bias voltages applied to the cleaning roller 101 and cleaning shaft 102 differ by a substantially constant amount. Thus, the potential difference between the cleaning roller 101 and the cleaning shaft 102 is maintained constant. In this embodiment, both of the cleaning roller 101 and cleaning shaft 102 are maintained at a negative potential.

Accordingly, an electrostatic attraction is generated between the cleaning roller 101 and the toner deposited on the conveying belt 33. It is considered that the electrostatic attraction is generated due to the potential difference between the cleaning roller 101 and the conveying belt 33. This electrostatic attraction attracts toner from the surface of the conveying belt 33 to the cleaning roller 101, thereby cleaning the conveying belt 33.

At this time, the bias voltage to the cleaning shaft 102 is controlled to have an absolute value greater than an absolute value of the bias voltage to the cleaning roller 101. Hence, toner attracted to the cleaning roller 101 is subsequently transferred to the cleaning shaft 102.

After toner is deposited on the surface of the cleaning shaft 102, a thin plate-shaped scraping blade 103 scrapes the toner off the cleaning shaft 102. And, then the toner-conveying pump mechanism 110 conveys the toner to the toner collecting section 105.

A scatter prevention blade 104 is provided for preventing toner scraped off the cleaning shaft 102 from scattering toward the cleaning roller 101. The scatter prevention blade 104 is configured of a flexible thin film having one end fixed to the inner wall of a casing 108 and the other end slidably contacting the outer surface of the cleaning shaft 102.

The toner-conveying pump mechanism 110 is configured of an elliptical rotor 111 for rotating and pushing toner scraped off the cleaning shaft 102 toward the inlet 107; a first wall 112 and a second wall 113 arranged partially around the elliptical rotor 111; and a lead valve 115 for preventing toner conveyed into the collection space 106 from coming back out.

As shown in FIG. 1, the image-forming unit 10 is configured of a scanning unit 60, the process cartridges 70, and the fixing unit 80.

In this embodiment, the image-forming unit 10 uses a direct tandem system for printing color images. The image-forming unit 10 includes four process cartridges 70K, 70Y, 70M, and 70C corresponding to the four colors black, yellow, magenta, and cyan juxtaposed in the order given along the paper-conveying direction.

The scanning unit 60 is disposed in the upper section of the casing 3 and functions to form electrostatic latent images on surfaces of photosensitive drums 71 provided in each of the process cartridges 70. The scanning unit 60 includes laser light sources, a polygon mirror, Fθ lenses, and reflecting mirrors (not shown)

The laser light sources emit laser beams based on image data. The laser beams are deflected off the polygon mirror, pass through the Fθ lenses, and are bent by the reflecting mirrors. The reflecting mirrors deflect the light beams along a downward optical axis so that the laser beams irradiate the surfaces of the photosensitive drums 71 to form electrostatic latent images thereon.

The four process cartridges 70K, 70Y, 70M, and 70C differ only in the color of toner used, but otherwise have the same construction. Therefore, the process cartridges 70K, 70Y, 70M, and 70C will be collectively referred to as the process cartridges 70. Next, the structure of the process cartridges 70 will be described using the cyan process cartridge 70C as an example.

The process cartridge 70C is detachably provided in the casing 3 below the scanning unit 60. The process cartridge 70C includes the photosensitive drum 71, a charger 72, and a casing 75 having a toner-accommodating section 74.

The photosensitive drum 71 is configured of a cylinder having a positive-charging photosensitive layer formed of polycarbonate on the outermost surface. The photosensitive drum 71 carries an image to be transferred onto the sheet.

The charger 72 functions to charge the surface of the photosensitive drum 71. The charger 72 is disposed at a position diagonally above and rearward of the photosensitive drum 71 and faces the photosensitive drum 71 at a prescribed distance without contacting the photosensitive drum 71.

A transfer roller 73 is rotatably supported on a frame member on the opposite side of the photosensitive drum 71C with respect to the conveying belt 33.

The transfer roller 73 is disposed in confrontation with the photosensitive drum 71 and rotates in association with movement of the conveying belt 33. When the sheet passes near the photosensitive drum 71, the transfer roller 73 applies a charge of an opposite polarity to the polarity of the charge on the photosensitive drum 71 (a negative charge in this embodiment) to the back side of the sheet which is opposite to the printed surface, causing toner deposited on the surface of the photosensitive drum 71 to transfer onto the printed surface side of the paper.

The toner-accommodating section 74 includes a toner-accommodating chamber 74A for accommodating toner, a toner supply roller 74B for supplying toner from the toner-accommodating chamber 74A onto the photosensitive drum 71, and a developing roller 74C.

The toner supply roller 74B rotates to supply toner from the toner-accommodating chamber 74A to the developing roller 74C. The toner supplied to the developing roller 74C is carried on the surface thereof to be supplied onto the surface of the photosensitive drum 71 exposed by the scanning unit 60. However, before the toner is supplied to the photosensitive drum 71, a thickness-regulating blade 74D regulates the thickness of the toner carried on the surface of the developing roller 74C to a uniform thickness, As the conveying belt 33 circulates, the sheet conveyed from the paper tray 21 to the conveying belt 33 is carried on the surface of the conveying belt 33 and conveyed sequentially to the process cartridges 70K, 70Y, 70M, and 70C.

The fixing unit 80 is disposed along the paper-conveying path downstream of the photosensitive drum 71 in the process cartridge 70C. The fixing unit 80 functions to fix the toner transferred onto the sheet by heat.

The fixing unit 80 includes a heating roller 81, and a pressure roller 82.

The heating roller 81 rotates in synchronization with the developing roller 74C and the conveying belt 33. The pressure roller 82 disposed in confrontation with the heating roller 81 receives the rotational force from the heating roller 81 through the paper and follows the rotation of the heating roller 81.

The image-forming unit 10 forms an image on paper as follows. First, the chargers 72 apply a uniform positive charge to the surfaces of the photosensitive drums 71 as the photosensitive drums 71 rotate. Subsequently, the scanning unit 60 irradiates laser beams in a high-speed scan, exposing the surfaces of the photosensitive drums 71 to form electrostatic latent images on the surfaces of the photosensitive drums 71 corresponding to an image to be formed on the sheet.

As the developing rollers 74C rotate, positively charged toner carried on the surfaces of the developing rollers 74C comes into contact with the photosensitive drums 71. At this time, the toner is selectively supplied to the electrostatic latent images formed on the surfaces of the photosensitive drums 71, i.e. areas that were exposed by the laser beams and, therefore, have a lower potential. As a result, the electrostatic latent images on the photosensitive drums 71 are developed into visible images through reverse development, resulting in toner images being carried on the surfaces of the photosensitive drums 71.

Subsequently, the toner images carried on the surfaces of the photosensitive drums 71 are transferred onto the sheet by the transfer bias applied to the transfer rollers 73. After the toner images are transferred onto the sheet, the sheet is conveyed to the fixing unit 80. The fixing unit 80 applies heat to the sheet for fixing the toner image on the sheet, thus completing image formation.

After image formation in the image-forming unit 10 is completed, an intermediate transfer roller 90 conveys the sheet along a discharge chute (not shown), which again inverts the sheet so that the conveying direction is changed about 180 degrees. Discharge rollers 91 disposed at the top of the casing 3 discharge the sheet through a discharge section 7 onto the discharge tray 5.

Figure 3:
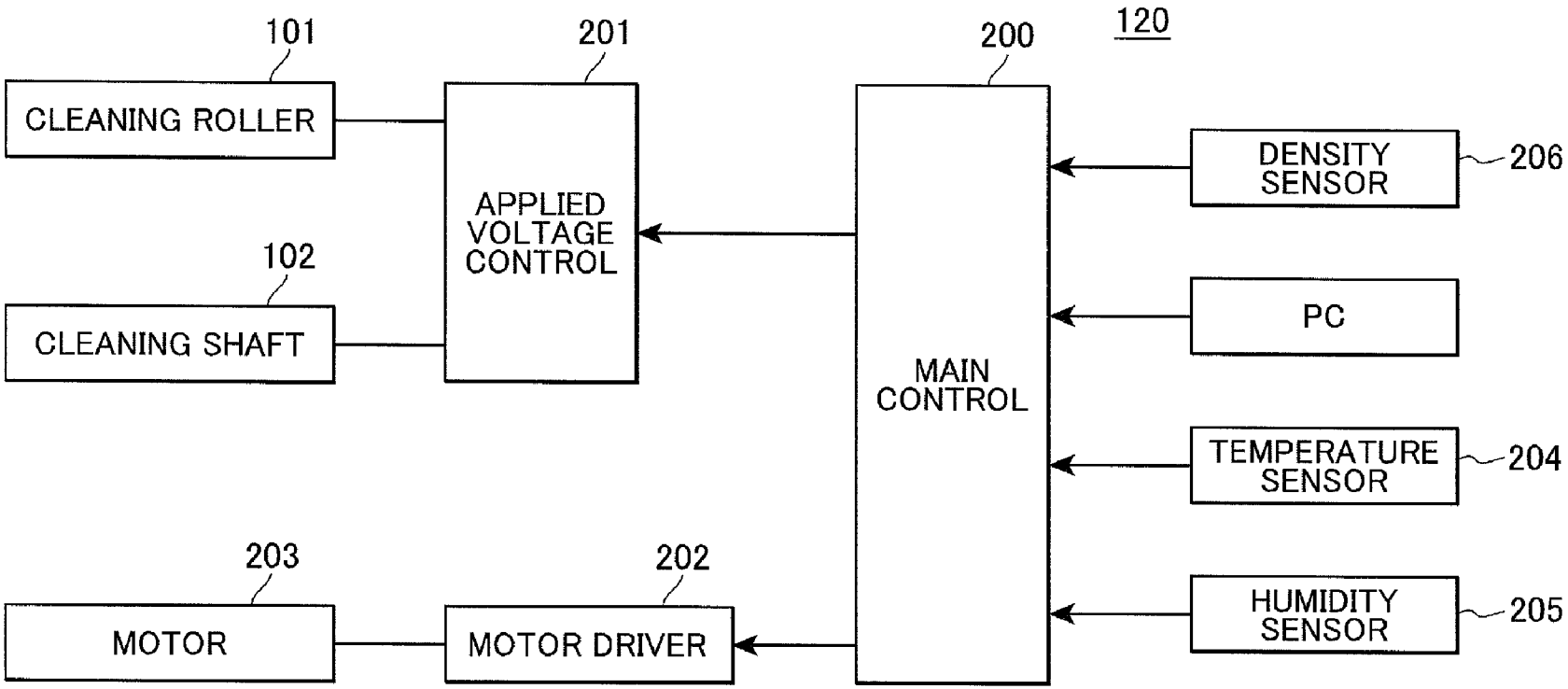
FIG. 3 is a block diagram of a control system for controlling operations of the belt cleaner.

FIG. 3 shows a control system 120 for the belt cleaner 100. The control system 120 has a main control circuit 200 that controls the operations of the belt cleaner 100. The control system 120 mainly controls an applied voltage control circuit 201 and a motor driving circuit 202. As shown in FIG. 3, the applied voltage control circuit 201 functions to apply the bias voltages to the cleaning roller 101 and cleaning shaft 102. The motor driving circuit 202 functions to drive an electric motor 203, which in turn drives the cleaning roller 101 and the elliptical rotor 111 in the toner-conveying pump mechanism 110.

The main control circuit 200 is configured of a CPU, a RAM, and a ROM. The ROM stores programs to be executed by the CPU. The main control circuit 200 is electrically connected to a temperature sensor 204 for detecting the internal temperature in the casing 3, a humidity sensor 205 for detecting the internal humidity in the casing 3, and a density sensor 206 for detecting the toner density of the toner deposited on the conveying belt 33 Each of the sensors sends an output signal to the main control circuit 200. In this embodiment, the humidity sensor 205 detects relative humidity in the casing 3 as the output signal.

Figure 4:
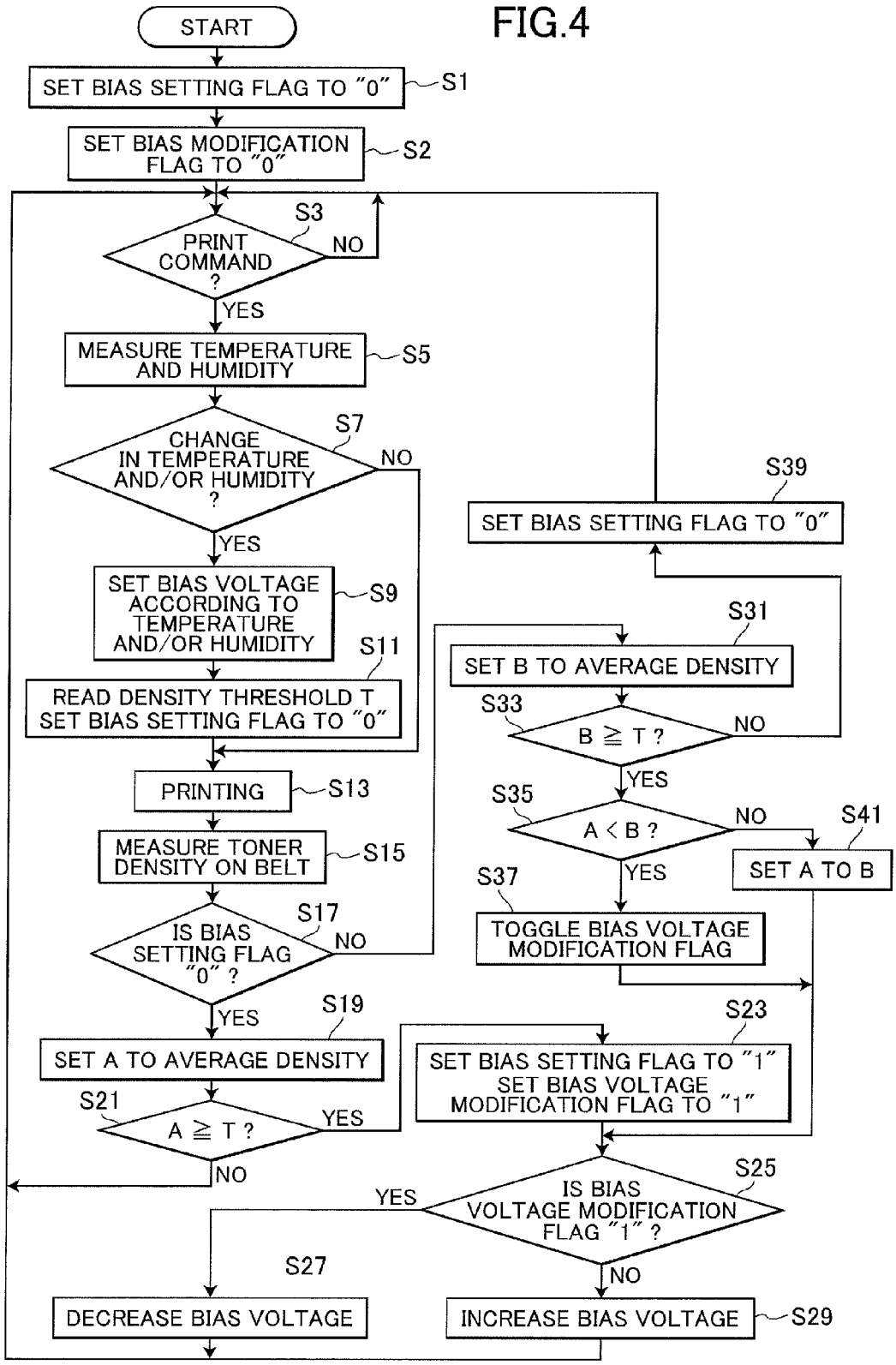
FIG. 4 is a flowchart showing a control procedure for determining a bias voltage.

The main control circuit 200 determines the bias voltage to apply to the cleaning roller 101 according to the procedure shown in FIG. 4, and controls the applied voltage control circuit 201 to apply the determined bias voltage to the cleaning roller 101. It should be noted that the potential difference between the cleaning roller 101 and the cleaning shaft 102 is controlled to maintain constant. Therefore, when the bias voltage to the cleaning roller 101 is determined, the bias voltage to the cleaning shaft 102 is automatically determined. Thus, the following description will be described, mainly focusing on the bias voltage to the cleaning roller 101.

Since the toner takes on a positive charge in this embodiment, the potential of the bias voltage to the cleaning roller 101 is negative. Accordingly, in order to simplify the following description, the bias voltage has a negative polarity and the magnitude thereof indicates an absolute value, unless otherwise specified. Further, increasing the bias voltage denotes increasing the absolute value of the bias voltage. Decreasing the bias voltage denotes decreasing the absolute value of the bias voltage.

Referring to FIG. 4. The control procedure is started when the power switch (not shown) of the laser printer 1 is turned on and is halted when the power switch is turned off. A program for implementing the control procedure is stored in the ROM or another storage device in the main control circuit 200.

When the power switch of the laser printer 1 is turned on, in S1 the main control circuit 200 stands by the first sequence for determining the bias voltage based on the toner density of the deposited toner on the conveying belt 33. The first sequence has a flag indicating whether the first sequence is activated or not (designated as "bias setting flag" hereinafter). The bias setting flag of "0" indicates that the first sequence is not activated, while the bias setting flag of "1" indicates that the first sequence is activated. In S1, the bias setting flag is set to 0. In other words, the first sequence is not activated.

In S2, the main control circuit 200 simultaneously stands by the second sequence for changing the bias voltage. The second sequence has a flag indicating whether the absolute value of the bias voltage is required to be increased or decreased (designated as "bias modification flag" hereinafter) In this embodiment, the bias voltage modification flag set to 1 indicates that the absolute value of the bias voltage is required to be decreased, while the bias voltage modification flag of 0 indicates that the absolute value of the bias voltage is required to be increased.

In S3 the main control circuit 200 determines whether a print command is issued from a personal computer (hereinafter referred to as "PC") connected to the laser printer 1. If a print command has not been issued from the PC (S3: NO), then the laser printer 1 continues to wait until the print command is issued.

When the main control circuit 200 determines that the PC has issued a print command (S3: YES), then in S5 the main control circuit 200 reads a detected temperature T from the temperature sensor 204 (hereinafter referred to as "temperature T") and a detected humidity H from the humidity sensor 205 (hereinafter referred to as "humidity H"), and stores these values in the RAM. In S7 the main control circuit 200 compares the previously detected temperature T to the currently detected temperature T to determine whether the temperature T in the casing 3 has been changed. Simultaneously, the main control circuit 200 compares the previously detected humidity H to the currently detected humidity H to determine whether the humidity H in the casing 3 has been changed.

If the previously detected temperature T and the currently detected temperature T are the same and the previously detected humidity H and the currently detected humidity H are the same (S7: NO), then the main control circuit 200 advances to S13 without modifying the bias voltage which has been applied to the cleaning roller 101. In SS3 the main control circuit 200 performs printing for a prescribed amount of print data based on the print command issued from the PC.

Here, the prescribed amount of print data will correspond to a prescribed number of sheets. Hence, in this embodiment the procedure from 515 is executed each time one sheet of printing is completed, regardless of the number of sheets to be printed.

If the main control circuit 200 determines in S7 that the previously detected temperature T is different from the currently detected temperature T (S7: YES), then in S9 the main control circuit 200 determines the bias voltage according to the relationship between the optimum bias voltage and the temperature shown in FIG. 5, based on the currently detected temperature T.

If the main control circuit 200 determines in S7 that the previously detected humidity H is different from the currently detected humidity H (S7: YES), then in S9 the main control circuit 200 determines the bias voltage according to the relationship between the optimum bias voltage and the humidity shown in FIG. 6, based on the currently detected humidity H.

Figure 5:
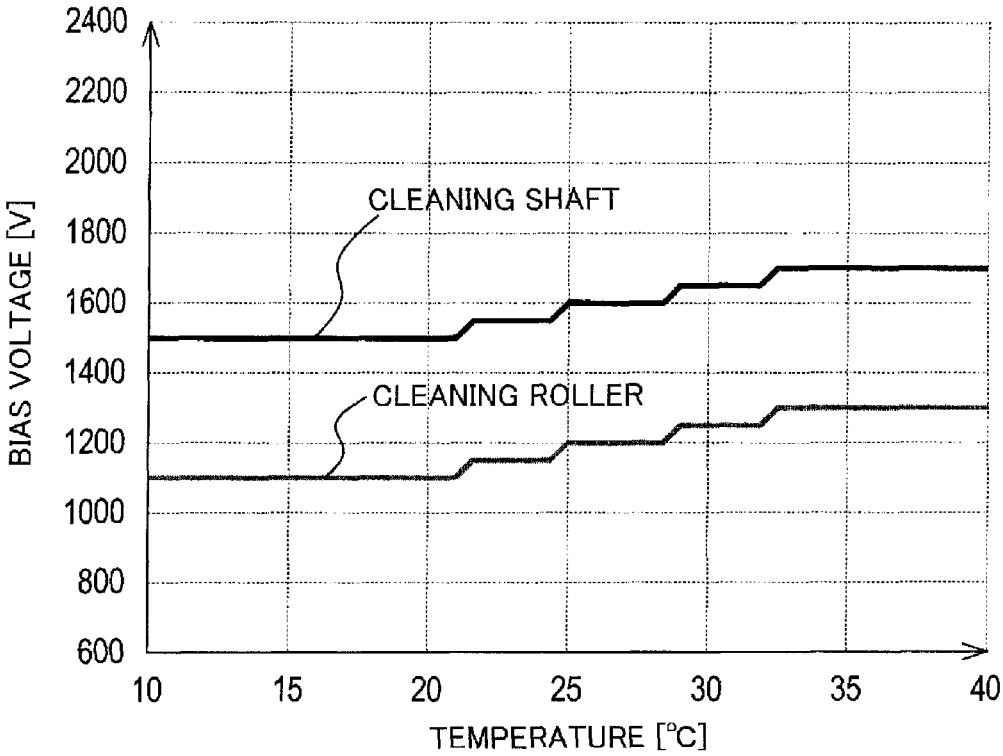
FIG. 5 is a graph illustrating the relationship between a temperature and an optimum bias voltage.
Figure 6:
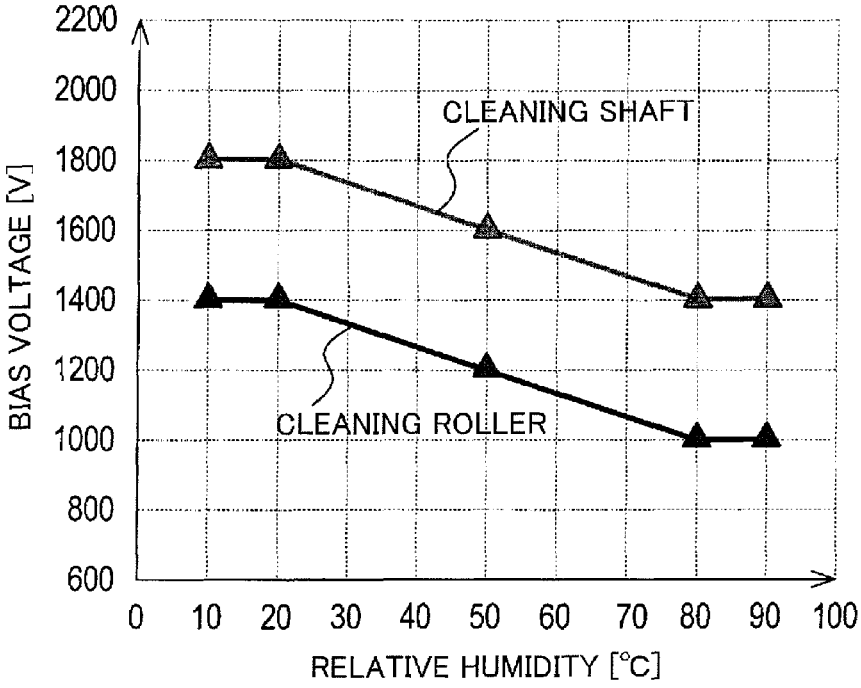
FIG. 6 is a graph illustrating the relationship between a humidity and an optimum bias voltage.

FIG. 5 shows the relationship between the temperature T and the optimum bias voltage. As shown in FIG. 5, the optimum bias voltage rises as the temperature T rises within the range of about 20-35° C. FIG. 6 shows the relationship between the humidity H and the optimum bias voltage. As shown in FIG. 6, the optimum bias voltage decreases as the humidity H rises within the range of about 20-90%. The two relationships shown in FIGS. 5 and 6 have close correlation to actually provide a three-dimensional map for determining the bias voltage from the temperature T and humidity H.

After setting the bias voltage in S9 of FIG. 4, in S11 the main control circuit 200 reads a threshold T from the ROM and sets the bias setting flag to 0. The threshold T is referred to as a density threshold T and functions as criteria to determine whether further cleaning of the conveying belt 33 is necessary or not. In other words, if the toner density is less than or equal to the threshold T, the cleaning of the conveying belt 33 is properly performed. On the other hand, if the toner density is more than the threshold T, the further cleaning of the conveying belt 33 is necessary.

In S11, the main control circuit 200 confirms that the bias setting flag is 0. If the bias setting flag is 1, the main control circuit. 200 set the bias setting flag to "0".

In this embodiment, the density threshold T is a constant value regardless of the number of sheets to be printed and environmental conditions including the temperature T and humidity H. However, the density threshold T may be adjusted based on the number of sheets being printed and environmental conditions.

In S13 the main control circuit 200 prints the amount of print data corresponding to the prescribed number of pages (one page in this embodiment) and in S15 interrupts the printing to check the detected toner density. In this embodiment, the main control circuit 200 detects the toner density on the conveying belt 33 at a plurality of locations by using the density sensor 206, while the conveying belt 33 is circulating.

In S17 the main control circuit 200 determines whether the bias setting flag is 0. If the bias setting flag is 0 (S17: YES), then in S19 the main control circuit 200 calculates and stores the average value of the detected toner densities in the RAM as a density A.

In S21 the main control circuit 200 compares the density A to the density threshold T. If the density A is less than the density threshold T (S21: NO), the main control circuit. 200 determines that the current bias voltage is proper for cleaning the conveying belt 33 and then returns to S3. On the other hand, if the density A is greater than or equal to the density threshold T (S21: YES), then in S23 the main control circuit 200 determines the current bias voltage is not proper for cleaning the conveying belt 33 and that the first sequence should be activated, thereby setting the bias setting flag to 1. At the same time, the main control circuit 200 sets a bias voltage modification flag to 1.

In S25 the main control circuit 200 determines whether the bias voltage modification flag is set to 1. If the bias voltage modification flag is set to 1 (S25: YES), then in S27 the main control circuit 200 decreases the absolute value of the bias voltage by a prescribed amount, and subsequently returns to S3.

On the other hand, if the bias voltage modification flag is not set to 1, i.e. is set to 0 (S25: NO), then in S29 the main control circuit 200 increases the absolute value of the bias voltage by the prescribed amount, and subsequently returns to S3.

After returning to S3, if the main control circuit 200 determines that all print data has been printed in S13 and that the PC has not issued a new print command (S3: NO), then the laser printer 1 waits for until the new print command has been issued.

Further, when the main control circuit 200 determines in S17 that the bias setting flag is not set to 0, i.e. that the bias setting flag is set to 1 (S17: NO), then in S31 the main control circuit 200 calculates and averages the plurality of detected toner densities read in the previous S15 and stores the averaged detected toner density in the RAM as a density B. The condition in which the bias setting flag has a value of "1" in S17 means that the procedure from S3 to S21 has been executed at least once, in the previous S21 the averaged toner density is more than the threshold, and in the previous S27 or S29, the bias voltage has been changed. Therefore, the density B is generally different from the density B due to the change in the bias voltage.

In S33 the main control circuit 200 compares the density B to the density threshold T. If the density B is less than the density threshold T (S33: NO), then in S39 the main control circuit 200 sets the bias setting flag to 0, and subsequently returns to S3. In other words the first sequence is completed. On the other hand, if the density B is greater than or equal to the density threshold T (S33: YES), then in S35 the main control circuit 200 compares the density A to the density B. In this case, the density B is the currently detected averaged toner density on the conveying belt 33. The density A is the previously detected averaged toner density on the conveying belt 33.

If the density B is greater than the density A at this time (S35: YES), then in S37 the main control circuit 200 toggles the bias voltage modification flag from its current value, and subsequently advances to S25. On the other hand, if the density B is less than or equal to the density A (S35: NO), then in S41 the main control circuit 200 updates the density A to the value of the density B, without modifying the bias voltage modification flag, and subsequently advances to S25. Since S25, the main control circuit 200 increases or decreases the bias voltage according to the value of the bias modification flag.

Figure 7:
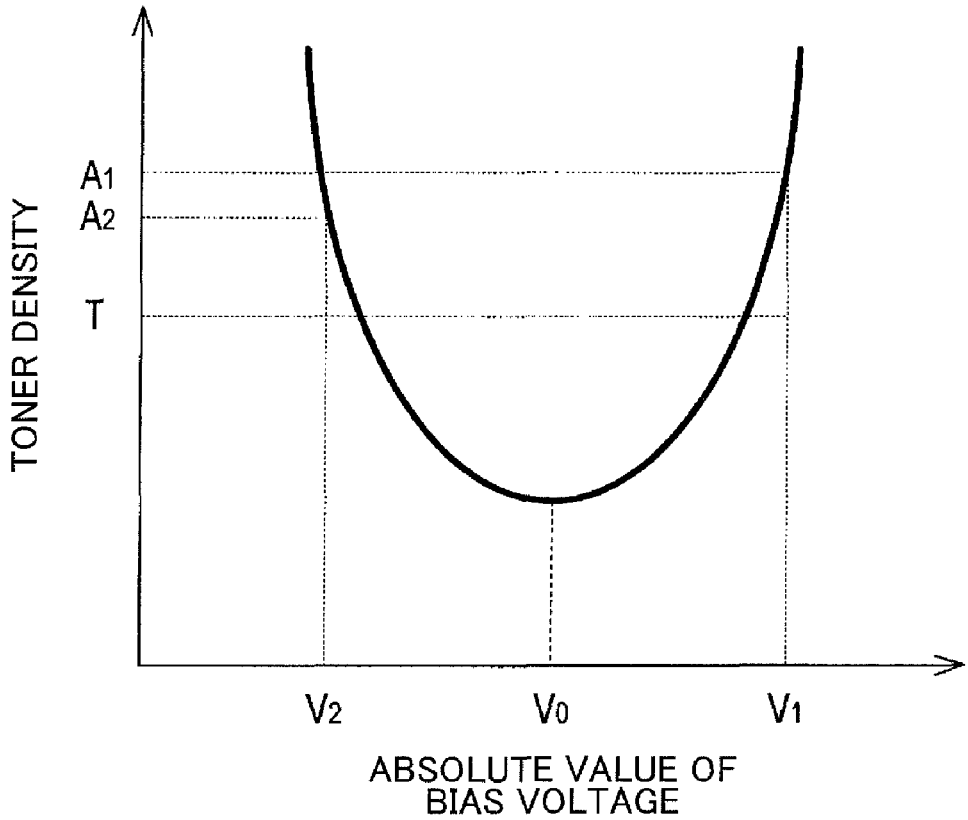
FIG. 7 is a graph showing the relationship between the residual density of toner on a conveying belt and the bias voltage.

As shown in FIG. 7, the relationship between the density of residual toner on the conveying belt 33 and the absolute value of the bias voltage is substantially parabolic. Further, when the absolute value of the bias voltage is $V_0$, the toner density on the conveying belt 33 is minimized. Preferably, if the detected toner density is less than the toner threshold T, the cleaning of the conveying belt 33 is properly performed. Hence, when the current bias voltage is inappropriate, the absolute value of the bias voltage may be optimized by increasing or decreasing the absolute value of the bias voltage.

Specifically, if the detected toner density is $A_1$ ($A_1$>T) when the bias voltage is $V_1$ ($V_1$>$V_0$), the bias voltage must be decreased toward $V_0$. On the other hand, if the bias voltage is $V_2$ ($V_2$<$V_0$) and the detected toner density is $A_2$ ($A_2$>T), the bias voltage must be increased toward $V_0$.

For this reason, the bias voltage applied to the cleaning roller 101 is optimized in this embodiment based on the toner density detected previously by the density sensor 206 and the toner density detected currently by the density sensor 206, as shown in S5-S41 of FIG. 4. Hence, even if the previous bias voltage is inappropriate, the current bias voltage can be adjusted in a suitable manner. Therefore, the bias voltage can almost always be set to a suitable for sufficiently removing toner from the conveying belt 33.

Specifically, in S17-S41 of FIG. 4, when the currently detected toner density is more than the previously detected toner density, and the absolute value of the current bias voltage is smaller than that of the previous bias voltage, the main control circuit 200 increases the bias voltage by a predetermined value.

Further, when the currently detected toner density is more than the previously detected toner density, and the absolute value of the current bias voltage is greater than that of the previous bias voltage, the main control circuit 200 decreases the bias voltage by the predetermined value.

When the currently detected toner density is less than the previously detected toner density, and the absolute value of the current bias voltage is smaller than that of the previous bias voltage, the main control circuit 200 decreases the bias voltage by the predetermined value.

When the currently detected toner density is less than the previously detected toner density, and the absolute value of the current bias voltage is greater than that of the previous bias voltage, the main control circuit 200 increases the bias voltage by the predetermined value.

Further, if the current toner amount detected by the density sensor 206 is less than or equal to the density threshold T, the main control circuit 200 does not have to change the bias voltage.

Further, since the density of residual toner on the conveying belt 33 is detected at a plurality of locations in this embodiment, any differences in the density of residual toner at different areas of the conveying belt 33 can be absorbed when the optimum bias voltage is determined.

As shown in FIG. 6, the optimum bias voltage is changed depending on the ambient humidity around the conveying belt 33 in the casing 3. When the main control circuit 200 determines that there is a change in the ambient humidity by the humidity sensor 205, the main control circuit 200 determines the bias voltage according to the detected humidity. In other words, the currently detected humidity is higher than the previously detected humidity, the main control circuit 200 decreases the bias voltage according to the relationship shown in FIG. 6. On the other hand, the currently detected humidity is lower than the previously detected humidity, the main control circuit 200 increases the bias voltage according to the relationship shown in FIG. 6. Accordingly, the main control circuit 200 determines the optimum bias voltage for cleaning the conveying belt 33, even if the humidity is changed during the operation of the laser printer 1.

As shown in FIG. 5, the optimum bias voltage is also changed depending on the ambient temperature around the conveying belt. 33 in the casing 3. When the main control circuit 200 determines that there is a change in the ambient temperature by the temperature sensor 204, the main control circuit 200 determines the bias voltage according to the detected temperature. In other words, the currently detected temperature is higher than the previously detected temperature, the main control circuit 200 increases the bias voltage according to the relationship shown in FIG. 5. On the other hand, the currently detected temperature is lower than the previously detected temperature, the main control circuit 200 decreases the bias voltage according to the relationship shown in FIG. 5. Accordingly, the main control circuit 200 determines the optimum bias voltage for cleaning the conveying belt 33, even if the temperature is changed during the operation of the laser printer 1.

As described above, the bias voltage has been optimized during the image forming operation (after the prescribed number of sheets are printed). The laser printer 1 can maintain applying the more optimum bias voltage than the case in which the bias voltage is optimized only when the laser printer 1 is turned on or when the laser printer 1 is restored from a sleep mode, for example.

Figure 8:
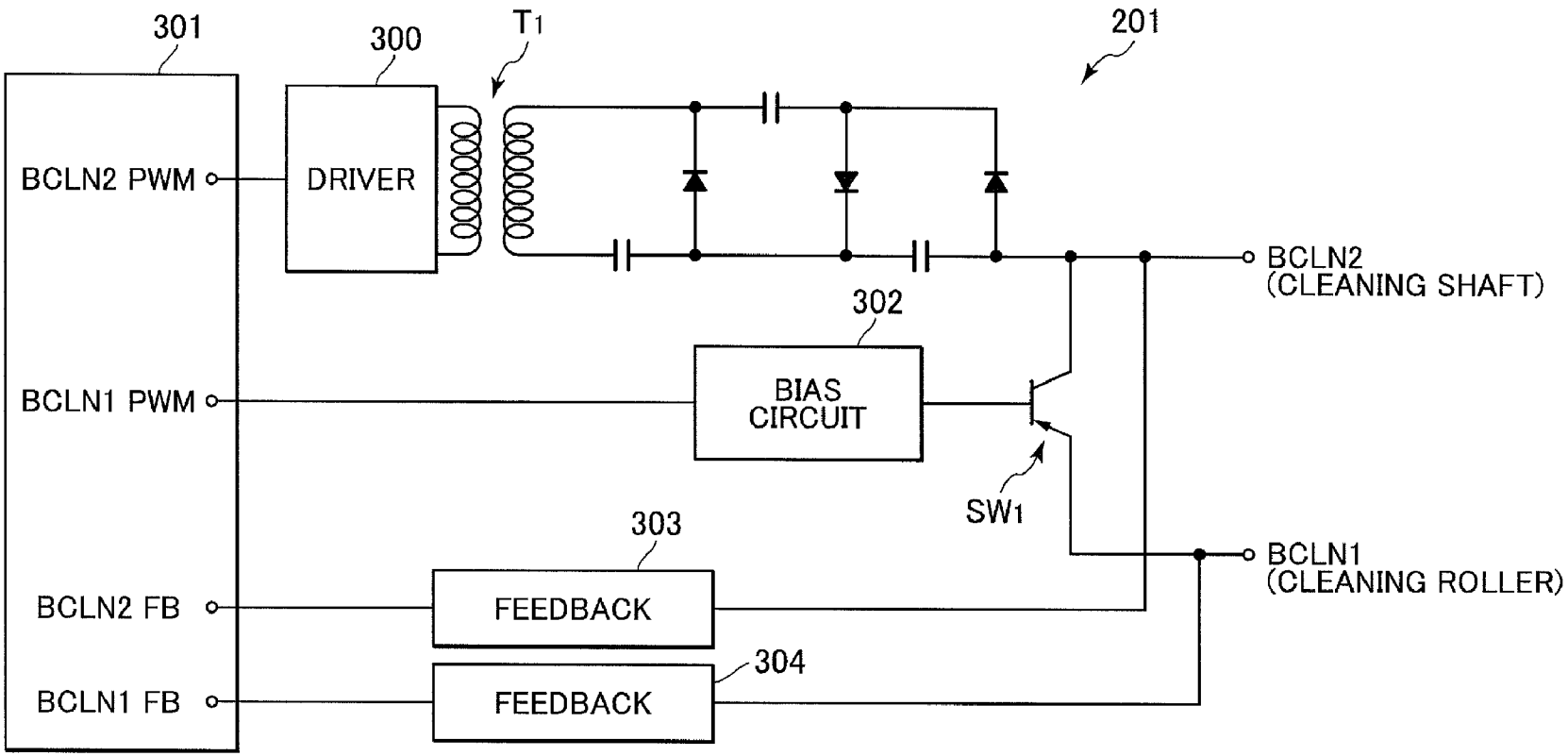
FIGS. 8-13 are circuit diagrams of an applied voltage control circuit according to other embodiments of the present invention.

FIG. 8 shows a circuit diagram of the applied voltage control circuit 201. Referring to FIG. 8, BCLN1 is an output terminal for the bias voltage applied to the cleaning roller 101, and BCLN2 is an output terminal for the bias voltage applied to the cleaning shaft 102.

The applied voltage control circuit 201 includes a drive circuit 300 for driving a transformer $T_1$, a bias circuit 302 for opening and closing a switch (switching transistor) $SW_1$, and the ASIC 301 that performs PWM control of the drive circuit 300 and the bias circuit 302. A feedback signal of the voltage outputted to the cleaning roller 101 and a feedback signal of the voltage outputted to the cleaning shaft 102 are inputted into the ASIC 301 via feedback circuits 303 and 304.

With this construction, the ASIC 301 can control the open-close duty ratio of the switch SW1 via the bias circuit 302 to control the bias voltage applied to the cleaning roller 101 based on the voltage applied to the cleaning shaft 102.

Hence, the applied voltage control circuit 201 has fewer transformers and other electric parts than a control circuit that independently controls the bias voltage applied to the cleaning roller 101 and the bias voltage applied to the cleaning shaft 102.

Figure 9:
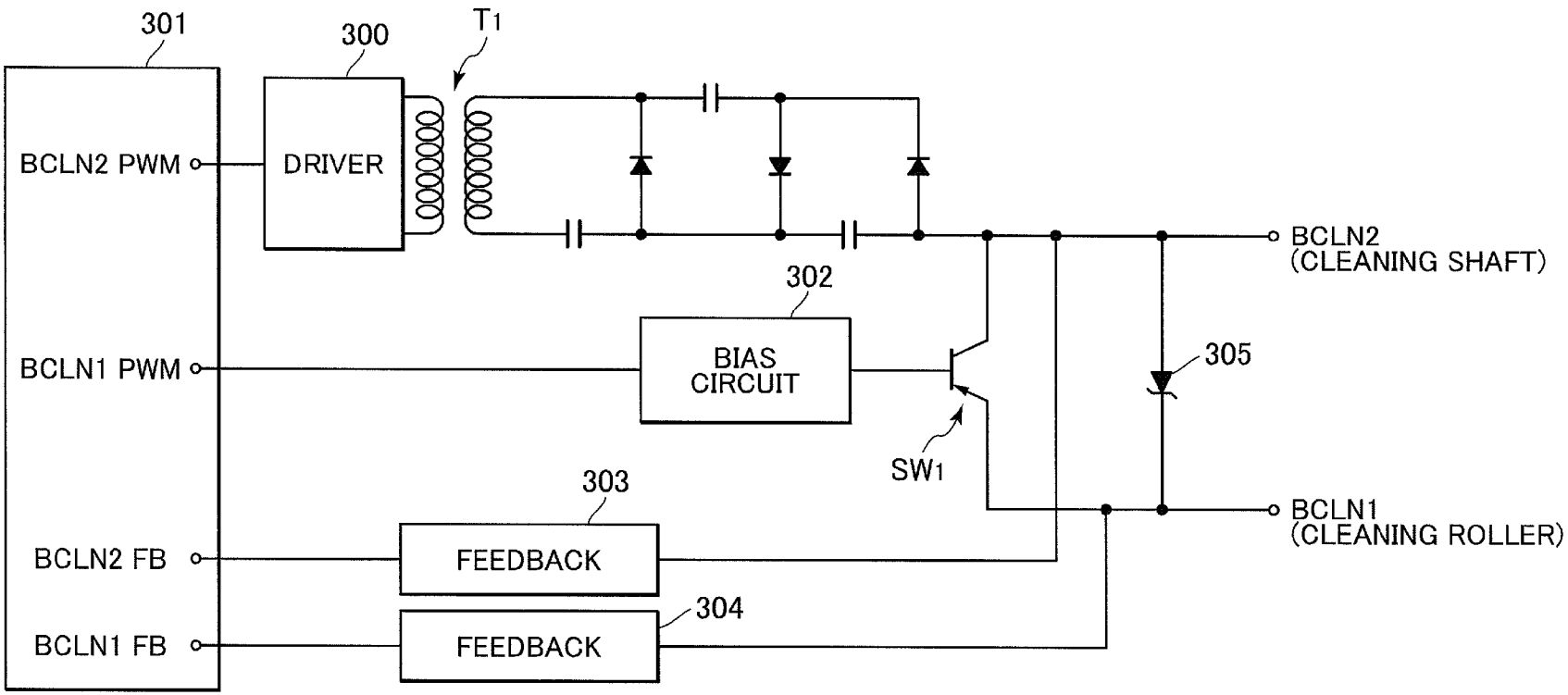

FIG. 9 shows another circuit diagram of the applied voltage control circuit 201. The applied voltage control circuit 201 has the same structure of that of FIG. 8 except a Zener diode 305. The Zener diode 305 is connected between the BCLN1 and the BCLN2 for protecting the switch SW1 and other shunt elements.

Figure 10:
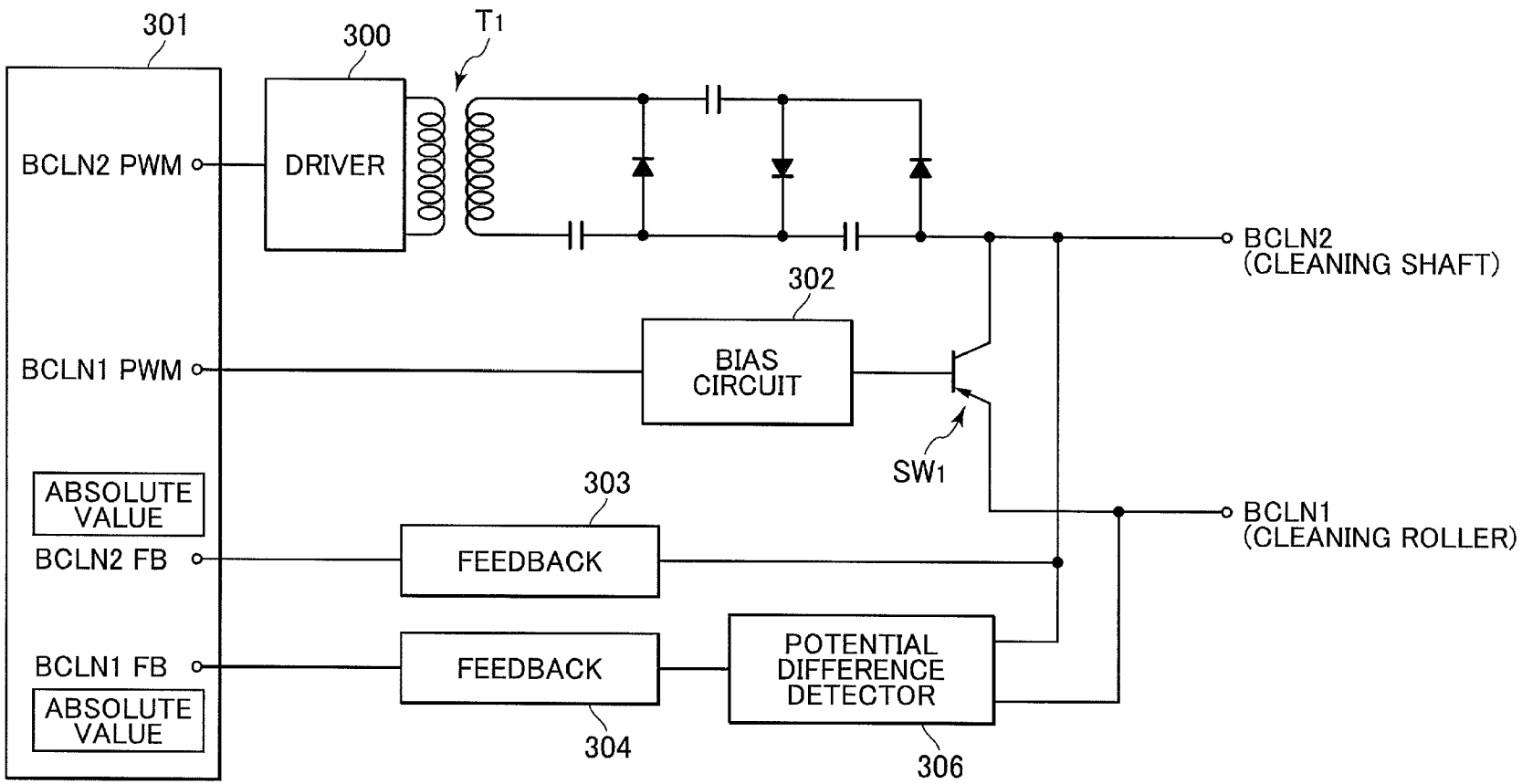

FIG. 10 shows a further circuit diagram of the applied voltage control circuit 201, in which the potential difference between the BCLN1 and the BCLN2 is used as a feedback signal for controlling the bias circuit 302. Thus, the applied voltage control circuit 201 is provided with a potential difference detecting circuit 306 for detecting the potential difference between the BCLN1 and the BCLN2. The other elements in the applied voltage control circuit 201 are the same as those of the applied voltage control circuit 201 of FIG. 8. The bias circuit 302 controls the bias voltage applied to the cleaning roller 101 based on a detection value received from the potential difference detecting circuit 306 using a PWM signal issued from the ASIC 301 based on the feedback signal.

With this construction shown in FIG. 10, the controllable range by the applied voltage control circuit 201, the difference between the minimum and maximum values of voltage, is smaller than the actual bias voltage being applied. Accordingly, the applied voltage control circuit 201 can control the bias voltage more precisely. That is, the bias voltage can be adjusted more precisely.

More specifically, the applied voltage control circuit 201 is required to control a bias having a voltage range of 0-2000 V by means of a feedback signal having 0-3.3 V, when the applied voltage control circuit 201 does not have the potential difference detecting circuit 306. However, when the applied voltage control circuit 201 have the potential difference detecting circuit 306, a potential difference between the cleaning roller 101 and cleaning shaft 102, having 0-800 V, can be controlled by a 0-3.3 V feedback signal, thereby reducing the burden of the applied voltage control circuit 201.

By performing fine-tuned control of the voltage, the laser printer 1 can control the bias voltage more precisely. Since the bias voltage can be maintained at an optimum voltage in this way, the laser printer 1 can sufficiently remove toner from the conveying belt 33.

Figure 11:
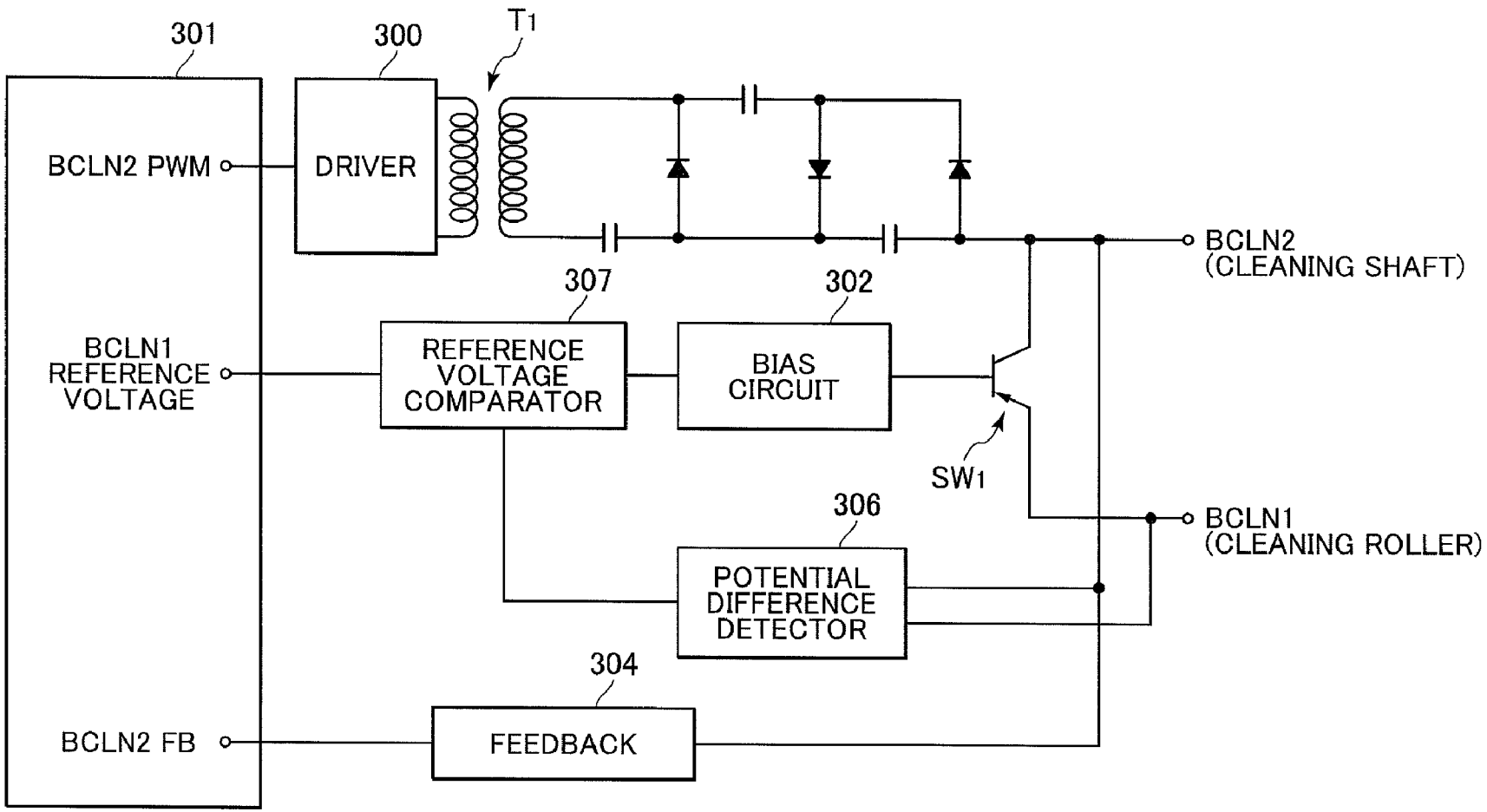

FIG. 11 shows still further circuit diagram of the applied voltage control circuit 201. In FIG. 11, the feedback circuit. 303 for controlling the bias circuit 302 has been eliminated. Instead, the applied voltage control circuit 201 includes a reference voltage comparison circuit 307. The reference voltage comparison circuit 307 receives an output signal from the potential difference detecting circuit 306 and controls the bias circuit 302.

Figure 12:
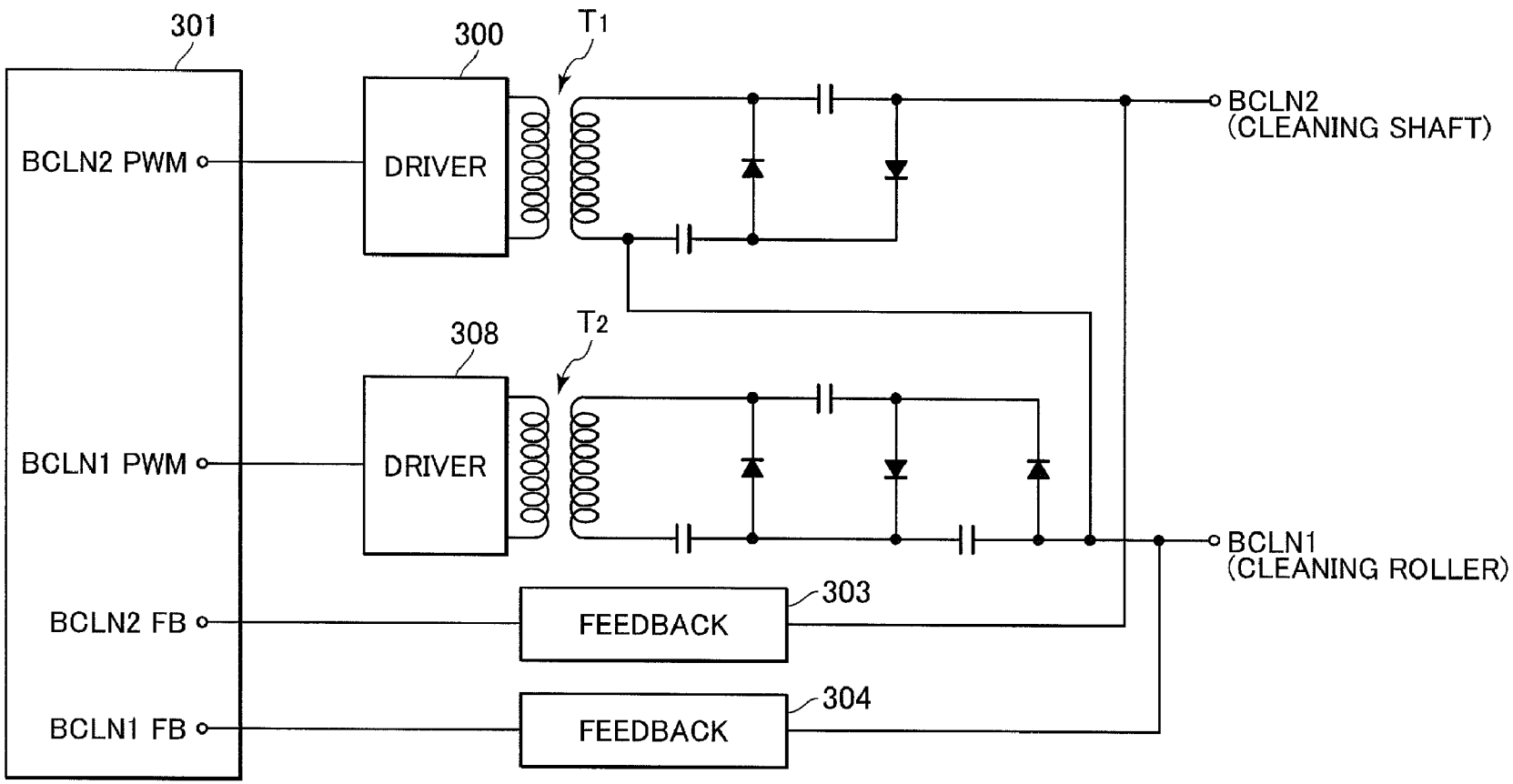

FIG. 12 shows a further circuit diagram of the applied voltage control circuit 201. The bias voltage applied to the cleaning shaft 102 is boosted based on the bias voltage applied to the cleaning roller 101, thereby reducing the number of stages in the step-up circuit (boost converter) configured of capacitors and diodes, In this embodiment, in addition to the transformer $T_1$ for the bias voltage applied to the cleaning shaft 102, another transformer T2 for the bias voltage applied to the cleaning roller 101, and a drive circuit 308 for the transformer $T_2$ are provided.

Figure 13:
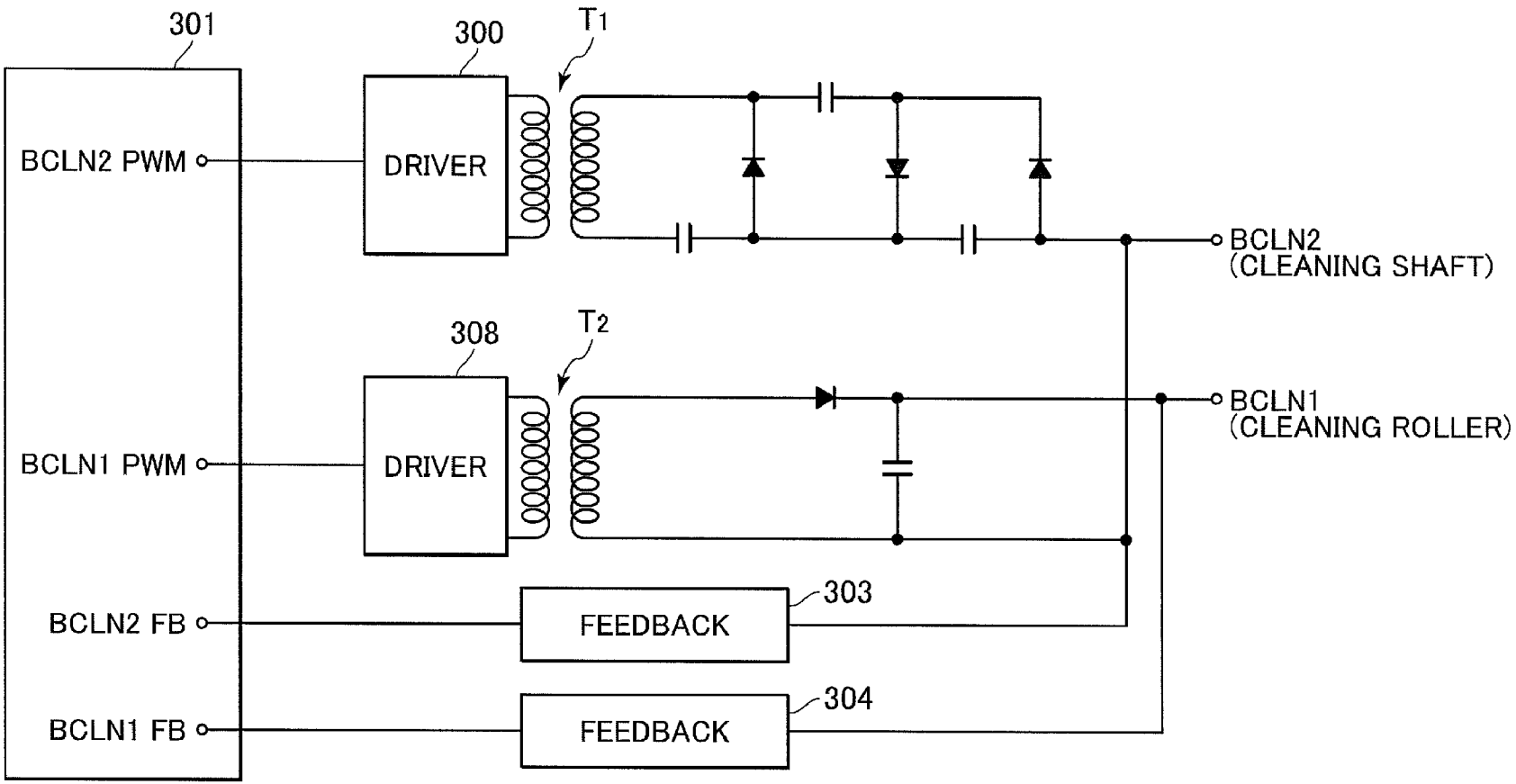

FIG. 13 shows a further circuit diagram of the applied voltage control circuit 201. In this embodiment, the bias voltage applied to the cleaning roller 101 is stepped down based on the bias voltage applied to the cleaning shaft 102, thereby reducing the number of stages in the step-down circuit (buck converter) configured of capacitors and diodes.

While the present invention is applied to a device for cleaning residual toner on the conveying belt 33 in the above embodiments, the present invention is not limited to the above configurations and may be applied to a device for cleaning residual toner from a photosensitive member on which toner is supplied to develop electrostatic latent images, and to an intermediate transfer belt for transferring onto a sheet a color image formed in a color laser printer by superimposing electrostatic latent images developed in a plurality of toner colors.

Further, the level of toner deposited on the conveying belt 33 may be detected in only one specific location of the conveying belt 33 rather than a plurality of locations as in the above embodiments.

As described above, the bias voltage applied to the cleaning roller 101 is determined based on the toner density previously detected by the density sensor 206 and the toner density currently detected by the density sensor 206. Hence, the bias voltage can be adjusted to an optimum value, even if the previously determined bias voltage is inappropriate.

Therefore, the bias voltage of the cleaning roller 101 can be always maintained at an optimum voltage for sufficiently removing toner from the conveying belt 33.

Further the optimum applied voltage can be determined while absorbing deviations in the detected toner densities on the conveying belt 33 at different locations thereon.

Additionally, the applied voltage control circuit 201 of FIG. 8 has fewer transformers and other electric parts than a construction for independently generating and controlling the bias voltages applied to the cleaning roller 101 and the cleaning shaft 102.

Further, the applied voltage control circuit 201 of FIGS. 10 and 11 can perform more precise control for the bias voltages applied to the cleaning roller 101 and the cleaning shaft 102. In other words, the control range by the applied voltage control circuit 201 only corresponds to the difference between the minimum and maximum values of voltages being controlled. Accordingly, more precise control of the bias voltages are performed. Hence, it is possible to maintain the bias voltage at the optimum voltage for sufficiently removing toner.

It is understood that the foregoing description and accompanying drawings set forth the embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. An image-forming device comprising:

a housing;

a cleaning target member provided in the housing;

a cleaning unit that applies a predetermined voltage to the cleaning target member to remove toner from the cleaning target member through an electrostatic force, the predetermined voltage having a predetermined absolute value;

a toner detection unit that detects an amount of toner on the cleaning target member at least twice, the detected amount of toner including a first amount of toner and a second amount of toner, the first amount of toner being detected when a first voltage having a first absolute value is applied as the predetermined voltage at a first time, the second amount of toner being detected when a second voltage having a second absolute value is applied as the predetermined voltage at a second time, and the second time being later than the first time; and a control unit that determines the predetermined absolute value on the basis of the first amount of toner and the second amount of toner.

2. The image-forming device according to claim 1, wherein the toner detection unit detects the amount of toner on the cleaning target member at a plurality of locations.

3. The image-forming device according to claim 1, wherein the control unit comprises a first determination unit that determines whether the detected amount of toner is more than a threshold value, and the control unit changes the predetermined absolute value when the first determination unit determines that the detected amount of toner is more than the threshold value.

4. The image-forming device according to claim 3, wherein, the control unit further comprises a second determination unit that determines whether the second amount of toner is more than the first amount of toner, when the second determination unit determines that the second amount of toner is more than the first amount of toner, the control unit increases the predetermined absolute value if the second absolute value is less than the first absolute value, and the control unit decreases the predetermined absolute value if the second absolute value is more than the first absolute value.

5. The image-forming device according to claim 3, wherein, the control unit further comprises a second determination unit that determines whether the second amount of toner is less than the first amount of toner, when the second determination unit determines that the second amount of toner is less than the first amount of toner, the control unit decreases the predetermined absolute value if the second absolute value is less than the first absolute value, and the control unit increases the predetermined absolute value if the second absolute value is more than the first absolute value.

6. The image-forming device according to claim 3, wherein the control unit maintains the predetermined absolute value, when the first determination unit determines that the output value is less than or equal to the threshold value.

7. The image-forming device according to claim 3, wherein the threshold value indicates a standard determining whether further removal of toner from the cleaning target member is necessary.

8. The image-forming device according to claim 1, further comprising a humidity detection unit that detects humidity in the housing, wherein the control unit determines the predetermined absolute value, depending on the detected humidity, the control unit decreases the predetermined absolute value when the detected humidity has increased, and the control unit increases the predetermined absolute value when the detected humidity has decreased.

9. The image-forming device according to claim 1, further comprising a temperature detection unit that detects temperature in the housing, wherein the control unit determines the predetermined absolute value, depending on the detected temperature, the control unit increases the predetermined absolute value when the detected temperature has increased, and the control unit decreases the predetermined absolute value when the detected temperature has decreased.

10. The image-forming device according to claim 1, wherein the cleaning unit comprises:

a cleaning roller capable of rotating facing the cleaning target member to electrostatically attract the toner from the cleaning target member through a third voltage applied to the cleaning roller, the third voltage having a third absolute value, the cleaning roller being at a third potential; and a cleaning shaft that electrostatically attracts the toner from the cleaning roller through a forth voltage applied to the cleaning shaft, the forth voltage having a forth absolute value, the cleaning shaft being at a forth potential, and the control unit determines the third voltage and the forth voltage so that a difference between the third absolute value and the forth absolute value is maintained constant.

11. The image-forming device according to claim 9, wherein the cleaning unit further comprises a voltage application unit that applies the third voltage and the forth voltage, and the voltage application unit determines the forth voltage based on the predetermined voltage, and applies the third voltage, based on the forth voltage as a reference.

12. The image-forming device according to claim 10, further comprising a potential difference detection unit that detects a difference between the third potential and the forth potential to generate an output, wherein the control unit controls the predetermined voltage based on the output from the potential difference detecting unit.

13. The image-forming device according to claim 1, further comprising an image-forming unit including a plurality of process cartridges to form image on a sheet, wherein the cleaning target member conveys the sheet in a conveying direction, the plurality of process cartridges are juxtaposed in the conveying direction, and the cleaning target member is a conveying belt for conveying the sheet.

14. The image-forming device according to claim 1, wherein the control unit determines the predetermined absolute value, while the image-forming unit is operating.

15. A method, comprising:

applying a predetermined voltage to a cleaning target member in an image-forming device to remove toner from the cleaning target member through an electrostatic force, the predetermined voltage having a predetermined absolute value;

detecting an amount of toner on the cleaning target member at least twice, the detected amount of toner including a first amount of toner and a second amount of toner, the first amount of toner being detected when a first voltage having a first absolute value is applied as the predetermined voltage at a first time, the second amount of toner being detected when a second voltage having a second absolute value is applied as the predetermined voltage at a second time, and the second time being later than the first time; and determining the predetermined absolute value on the basis of the first amount of toner and the second amount of toner.

* * * * *